United States Patent [19]

Gordon, Jr.

[11] Patent Number: 4,793,494

[45] Date of Patent: Dec. 27, 1988

[54] BREAK-APART CONTAINER

[75] Inventor: Eugene W. Gordon, Jr., Marion, N.C.

[73] Assignee: Baxter Travenol Laboratories, Inc., Deerfield, Ill.

[21] Appl. No.: 59,344

[22] Filed: Jun. 8, 1987

[51] Int. Cl.[4] ..... B65D 5/54; B65D 5/48

[52] U.S. Cl. ..... 206/602; 206/620; 229/23 R; 229/52 B; 229/120.03; 229/120.38

[58] Field of Search ..... 229/23 R, 27, 52 B, 229/15, DIG. 12; 206/602, 611, 620, 634

[56] References Cited

U.S. PATENT DOCUMENTS

| | | | |
|---|---|---|---|
| 1,578,066 | 3/1926 | Bolingbroke | 206/602 |
| 2,287,729 | 6/1942 | Fallert | 229/15 |
| 2,312,598 | 3/1943 | Sprague | 229/52 B |
| 2,327,529 | 8/1943 | Kieckhefer et al. | 206/602 |
| 2,448,795 | 9/1948 | Grecco | 206/602 |
| 2,702,151 | 2/1955 | Guyer | 229/23 AB |
| 2,710,130 | 6/1955 | Grecco | 206/602 |
| 2,737,334 | 3/1956 | Halgren | 206/602 |
| 2,864,178 | 7/1956 | Keeler | 206/602 |
| 3,092,301 | 6/1963 | Selle | 206/602 |
| 3,099,380 | 7/1963 | Nathan | 229/27 |
| 3,127,991 | 4/1964 | Burnett | 229/17 R |
| 3,158,312 | 11/1964 | Simkins | 206/602 |
| 3,510,046 | 5/1970 | Reiner | 206/602 |
| 3,533,549 | 10/1970 | Gilchrist | 229/52 B |
| 3,627,116 | 12/1971 | Cooper | 229/DIG. 12 |
| 3,677,458 | 7/1972 | Gosling | 206/602 |
| 3,905,646 | 9/1975 | Brackmann et al. | 229/23 R |
| 3,921,893 | 11/1975 | Randle, Jr. | 229/23 R |
| 4,194,678 | 3/1980 | Jasper | 229/23 R |
| 4,256,223 | 3/1981 | Pawlowski | 206/602 |
| 4,282,999 | 8/1981 | Moen | 229/23 R |
| 4,377,237 | 3/1983 | Pawlowski | 206/602 |
| 4,508,258 | 4/1985 | Graser | 229/52 B |
| 4,529,117 | 7/1985 | Brundage | 229/27 |
| 4,533,052 | 8/1985 | Fruchey et al. | 206/602 |

FOREIGN PATENT DOCUMENTS

| | | |
|---|---|---|
| 1106269 | 3/1968 | United Kingdom . |

*Primary Examiner*—Stephen Marcus
*Assistant Examiner*—Gary E. Elkins
*Attorney, Agent, or Firm*—Paul C. Flattery; Garrettson Ellis

[57] ABSTRACT

A break-apart container which comprises: abutting first and second compartments, the first and second compartments each defining a facing wall that lies against the facing wall of the outer compartment in face-to-face relation. The facing walls may be sealed together only with manually frangible seals, and the break-apart container is retained within a wrapper.

7 Claims, 3 Drawing Sheets

BREAK-APART CONTAINER

BACKGROUND OF THE INVENTION

The invention of this application relates to a carton or container which is used to ship products to a site of use, and then can be broken in half, with the half containers still performing their function of holding the products. Thus, at the site of use, the half-size containers are more easily carried around and manipulated.

Particularly in the medical field, large volume containers of parenteral solutions, typically one liter containers, are shipped to hospitals and clinics in normal-sized packing cartons, which are handled by delivery men and stored in a central storage area of the hospital or clinic. However, when the large containers are to be distributed to the hospital floors, the job of manipulating and using the containers transfers typically from delivery men to nurses, who have difficulty in handling the wholesized packing containers.

Accordingly, by this invention, a convenient design of shipping container is provided which can be broken in half with ease, without causing opening of either half container. These half containers are much more easily handled by nurses.

Thus, the bulk shipping of products is facilitated by this container, which may be of normal size for standard shipping containers. However, for the benefit of the nurses and others who are less able to handle bulk shipping containers, the further advantage is provided that the container may be broken into half containers which are much easier to handle. This also provides the additional advantage that a half container of the product may be all that is desired on a ward floor or any other place of final use. This permits such half container to be readily provided to the final site of use, while the advantages of bulk shipment of a full container are still achieved.

DESCRIPTION OF THE INVENTION

In accordance with this invention, a break-apart container is provided which comprises abutting first and second compartments. The first and second compartments each define a facing wall that lies against a facing wall of the other compartment in face to face relation. The facing walls are preferably sealed together only with manually frangible seal means, for example, a glue line or the like. Additionally, the break-apart container is retained within wrapping means, typically a shrink wrap of known type. This wrapping means not only provides protection of the inner container against dust and dirt, but it serves as a structural member to hold the containers together during shipment, until it is desired to break the containers into their component halves.

The container preferably comprises an inner member having a central web portion, and opposed flange portions carried on the web portion, to exhibit an I-shaped cross section and to define spaces between the flange portions. The central web portion comprises the sealed-together, facing walls described above.

Additionally, the container also preferably comprises an outer member that folds about the inner member, to close the spaces between the opposed flange portions, to provide the completed package of this invention.

Typically, the outer member defines abutting ends adjacent one end of the facing walls described above, with the ends being essentially unsealed to each other. The outer member also defines a transverse line of tearing weakness to permit severing of the outer member in half, the transverse line of weakness being positioned adjacent and along the end of the facing walls opposed to said one end. The outer member is sealed to the inner member, with the result that the above-described compartments may be separated by breaking the seal means which holds the facing walls together, when used, and also the transverse line of weakness, after the wrapping means has been removed. By this simple expedient, the single package may be broken into first and second compartments.

It is also desirable for punch-out hand hole means to be provided, the hand hole means defining a pair of punch-out hand holes positioned adjacent the junction line between angled walls of the container. Each punch-out hand hole is positioned on a different wall and spaced to permit one's hand to pass through both holes for convenient gripping.

Preferably, such punch-out hand hole means comprising hand hole pairs as described above are provided at opposite ends of the container, in separate compartments, with one hand hole of each of the hand hole means being connected to tear line container opening means.

DESCRIPTION OF SPECIFIC EMBODIMENT

Figure 2:
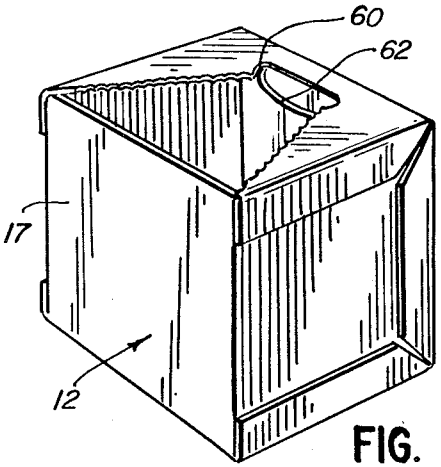
FIG. 2 is a perspective view of one of the broken-away compartments which comprises the container of this invention, shown in its opened condition.

Referring to the drawings, break-apart container 10 is shown to comprise abutting first and second compartments 12, 14, which compartments are enclosed in a shrink wrap 16 of conventional technology to assist in holding the compartments together. Each compartment is in itself an enclosed container in its original configuration, and defines a facing wall 17, 18 (see FIGS. 7 and 8). Facing walls 17, 18 may be adhered together with a glue line 20 of sufficient strength to hold wall 17, 18 together, but weak enough to permit the walls to be torn apart by the user.

Figure 5:
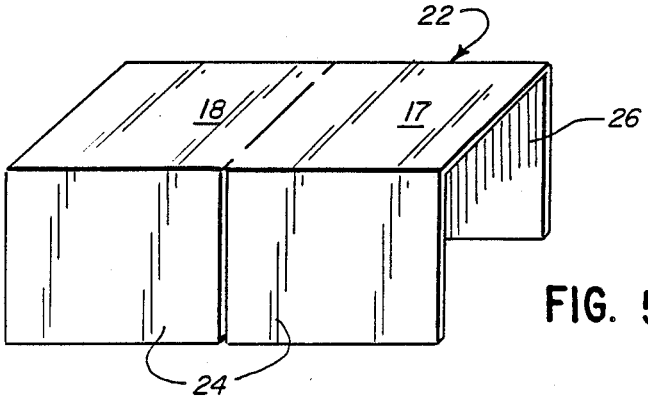
FIGS. 5 and 6 are perspective views of the corrugated cardboard sheet of FIG. 4 in sequential processes of assembly into the inner member.
Figure 6:
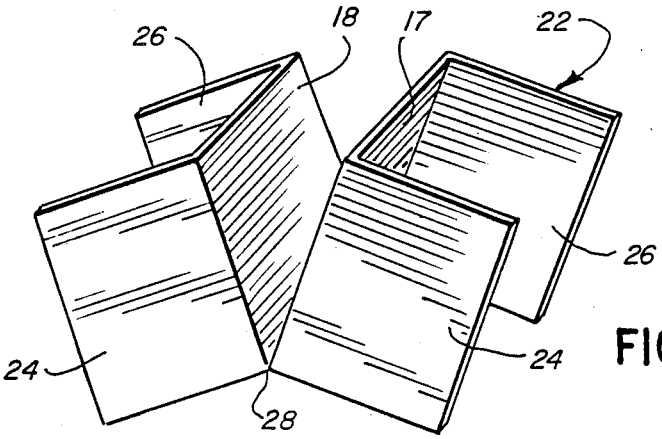

Facing walls 17, 18, form part of an inner member 22, which is made of a piece of corrugated cardboard, and is of the structure as shown in FIGS. 4 through 8. Specifically, inner member 22 may start out as in FIG. 4 as a flat sheet, from which opposed flange portions 24, 26 are folded as shown in FIG. 5 into perpendicular relation with facing walls 17, 18. Thereafter, facing walls 17, 18 are folded on fold line 28 as in FIG. 6 so that inner member 22 forms a structure of I-shaped cross section, with opposed flange portions 24, 26 projecting outwardly from a central web formed by facing walls 17, 18—see FIG. 7. Glue line 20 is applied as the structure is folded into I-shaped cross section to retain that cross section, and, preferably, fold line 28 may be severed so that two half portions of inner member 22 are retained in integral relation only by glue line 20 so that two half portions of inner member 22 may be easily separated when desired.

Figure 7:
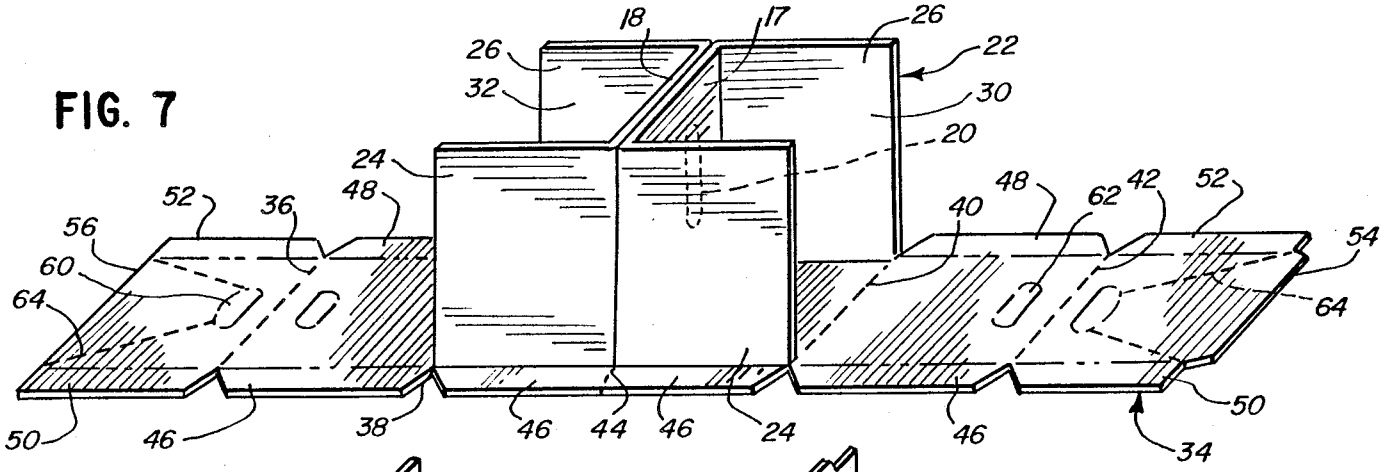
FIG. 7 is a perspective view of the flat, outer member having the inner member placed on it, in a further step in the assembly of the container of the invention.
Figure 8:
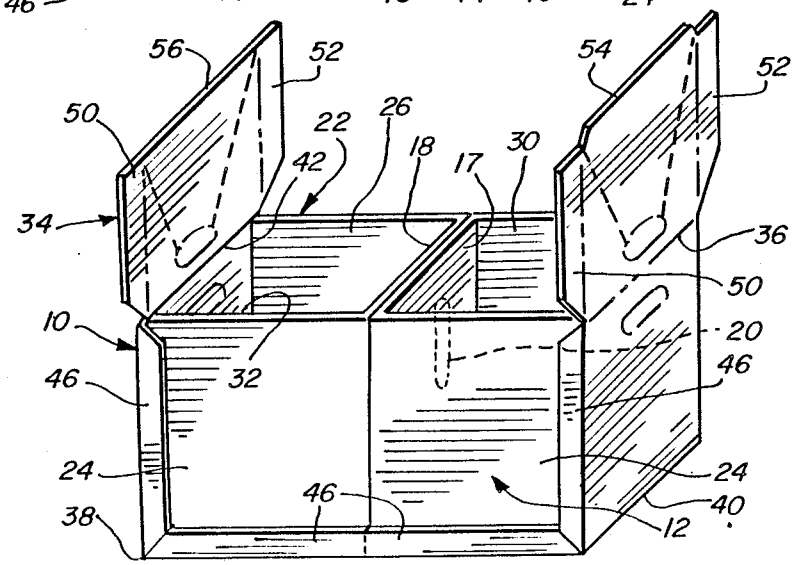
FIG. 8 is a perspective view of the container of this invention in a further manufacturing step.

It can also be seen that the resulting I-shaped inner member 22 defines a pair of opposed spaces 30, 32 between the respective flange portions 24, 26 as shown particularly in FIGS. 7 and 8.

Figure 3:
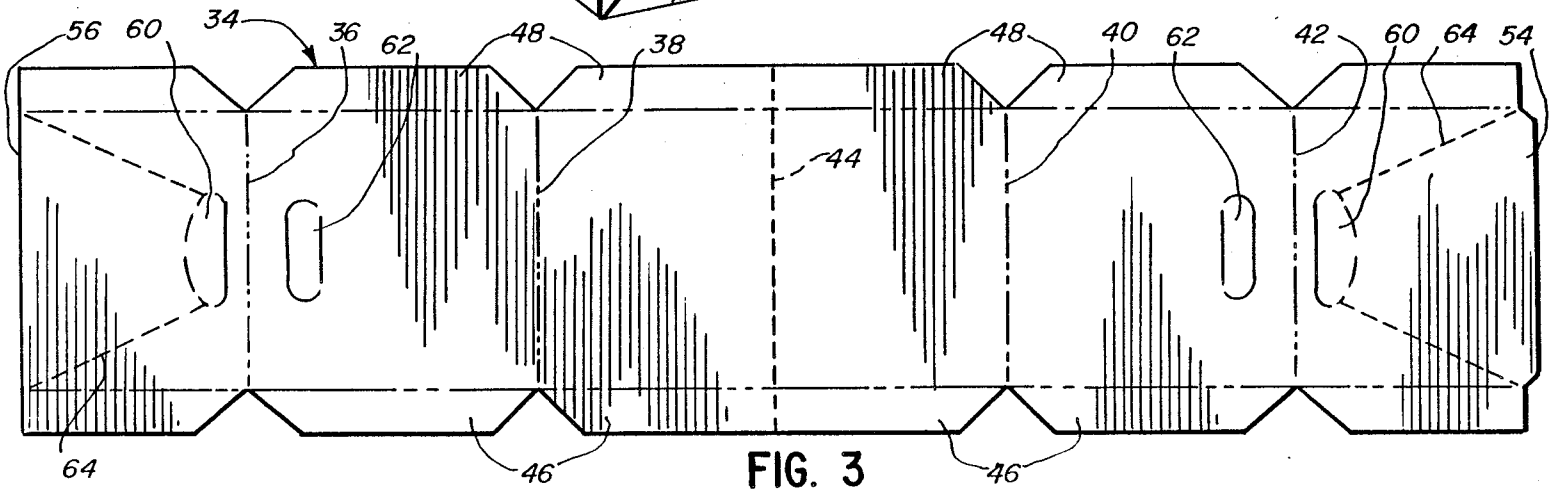
FIG. 3 is a plan view of a flat piece of corrugated cardboard which is used as the outer member described above, to fold about the inner member to form the completed container.
Figure 4:
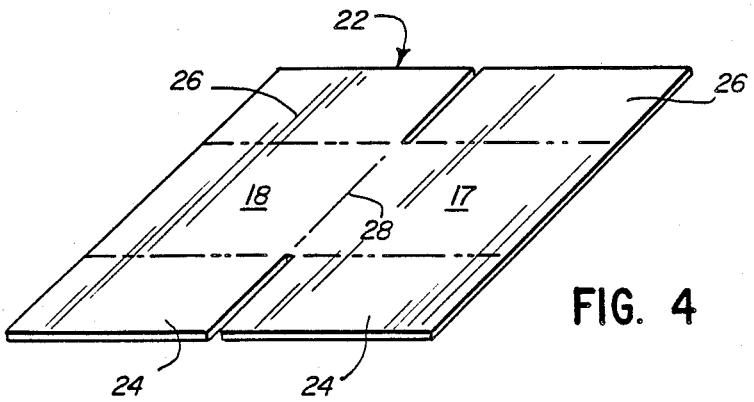
FIG. 4 is a perspective view of a flat piece of corrugated cardboard which is used to form the inner member.

Outer member 34 is shown in FIG. 3 in its flat condition as a piece of corrugated cardboard defining a series of fold lines 36, 38, 40, 42, and a central line of tearing weakness 44, to permit outer member to be manually torn in half.

As shown in FIG. 7, for assembly of the package, inner member 22 may be placed upon flat, outer member 34 as shown in FIG. 7. Then, fold lines 38 and 40 may be folded, and side tabs 46, 48 may be folded and sealed against the respective flanges 24, 26 for partial sealing of the container as shown in FIG. 8.

Thereafter, the contents may be inserted in the container, and the outer portions of outer member 34 may be pivoted down to seal spaces 30, 32, by folding along fold lines 36, 42. The container may be sealed by folding down tabs 50, 52 and gluing them to the respective flanges 24, 26. Following this, the shrink wrap 16 is applied, to achieve the fully assembled configuration of container 10 as shown in FIG. 1.

Figure 1:
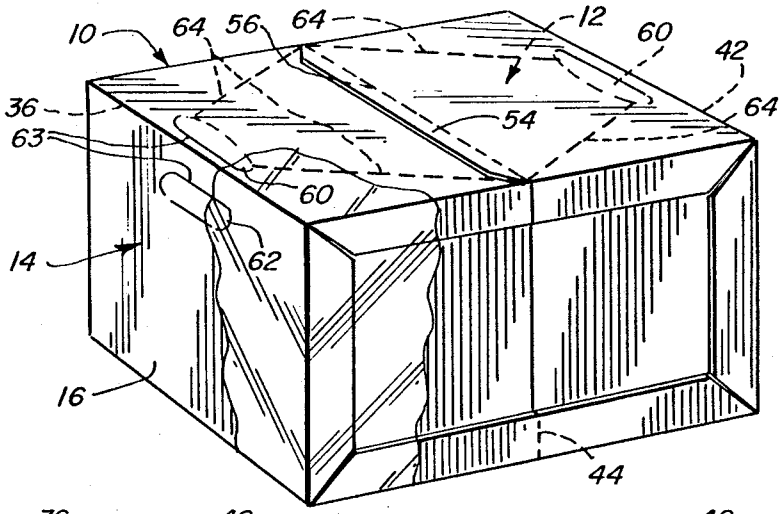
FIG. 1 is a perspective view of the container of this invention.

One end of outer member 34 defines a tab 54 which can lie on the opposed end 56 of outer member 34, so that the extreme ends of the outer member are in overlapping relation in the completed package of FIG. 1. Tab 54 serves as a dust shield. After the shrink wrap is removed, one may cause rupturing of seal line 20 and tear line 44, which causes the two compartments 12, 14 to break apart. As stated above, fold line 28 has been severed, so that it no longer provides any support between the two compartments 12, 14. Alternatively, fold line 28 may be broken at the time of opening. Nevertheless, the respective compartments 12, 14 still remain sealed because of the presence of facing walls 17, 18.

After opening of container 10 and separation of compartments 12, 14, the compartments may be conveniently opened and carried by the presence of punch-in hand hole means, each of which are shown to define a pair of punch-in hand holes 60, 62, which each have a punch-in portion with an upper fold line 63 so that one may open such portions and insert the hand into both the respective hand holes at once. Hand holes 60, 62 are positioned adjacent a junction line 36 or 42 between angled walls of the container, with each punch-in hand hole 60, 62 being positioned on a different wall and spaced to permit one's hand to pass through both holes for convenient gripping, after the central portions of each hand hole have been punched in.

Additionally, each compartment 12 may have a pair of diverging perforated tear lines 64 which extend from hand hole 60, so that one may tear open the top of compartment 12 by tearing perforation lines 64, beginning at hand hole 60, for easy opening.

Thus, by this means, a container is provided which may be easily broken in half by the user after shipping to a desired site, so that it may be more easily handled in final use, while remaining closed until actual use of the contents is desired.

The container of this invention represents a modification of a container known as the H-Bliss box of Moen Industries of Santa Fe Springs, Calif.

The above has been offered for illustrative purposes only, and is not intended to limit the scope of the invention of this application, which is as defined in the claims below.

That which is claimed is:

1. A break-apart container which comprises: abutting first and second compartments, said first and second compartments each being defined by an inner member having a central web portion and opposed flange portions carried on said web portion to exhibit an I-shaped cross-section, said central web portion defining a pair of facing walls folded together along a fold line during container formation, said facing walls respectively facing each compartment and abutting against the facing wall of the other compartment in face-to-face relation, said fold line being severed during container formation, and said facing walls being sealed together only with manually frangible seal means and integral with each other only through said seal means; said container also comprising an outer member that folds about said inner member to enclose spaces between said opposed flange portions, said outer member defining abutting ends adjacent one end of said facing walls, said abutting ends being essentially unsealed to each other, and said outer member also defining a transverse line of tearing weakness to permit severing said outer member in half, said transverse line of weakness being adjacent and along an end of said facing walls opposed to said one end, said outer member being sealed to said inner member, whereby said compartments may be separated by breaking said manually frangible seal means between the facing walls and said transverse line of tearing weakness without first opening the first and second compartments.

2. The break-apart container of claim 1 which is retained within wrapping means.

3. The container of claim 1 in which punch-out hand hole means are provided, said hand hole means defining a pair of punch-out hand holes positioned adjacent a junction line between angled walls of said container, each punch-out hand hole being positioned on a different wall and spaced to permit a hand to pass through both holes for convenient gripping.

4. The container of claim 3 in which said punch-out hand hole means are provided at opposed ends of said container, one hand hole of each of said hand hole means being connected to tear line container opening means.

5. A break-apart container which comprises:

abutting first and second compartments, said first and second compartments each defining a facing wall that lies against the facing wall of the other compartment in face-to-face relation, said facing walls being sealed together only with manually frangible seal means, said facing walls being otherwise separate and non-integral with the other facing wall, said container comprising an inner member defining said facing walls through a central web portion, said central web portion being formed by a pair of panels which are folded together along a fold line which has been subsequently severed prior to formation of the container, said inner member carrying opposed flange portions carried on said web portion to exhibit an I-shaped cross-section to define spaces between said opposed flange portions, said container comprising an outer member that folds about the inner member to enclose the spaces between said opposed flange portions, said outer member defining abutting ends adjacent one end of said facing walls, said ends being essentially unsealed to each other, and said outer member also defining a transverse line of tearing weakness to permit severing said outer member in half, said transverse line of tearing weakness being positioned adjacent and along an end of said facing walls opposed to said one end, said outer member being sealed to said inner member, whereby said first and second compartments may be separated by breaking said manually frangible seal means and said transverse line of weakness without opening said first or second compartment, each of said first and second compartments defining punch-out hand hole means, said hand hole means defining a pair of punch-out hand holes positioned adjacent the junction line between angled walls of said container, each punch-out hand hole being positioned on a different wall and spaced to permit hands to extend through both holes for convenient gripping.

6. The container of claim 5 in which said break-apart container is retained within wrapping means.

7. The container of claim 5 in which said punch-out hand hole means are provided at opposed ends of said container, one hand hole of each of said hand hole means being connected to tear line container opening means.

* * * * *